US010907369B2

(12) United States Patent
Guerra

(10) Patent No.: US 10,907,369 B2
(45) Date of Patent: Feb. 2, 2021

(54) SYSTEM FOR RE-ROOFING ASPHALT SHINGLED ROOFS

(71) Applicant: Vince Guerra, Hamilton (CA)

(72) Inventor: Vince Guerra, Hamilton (CA)

( * ) Notice: Subject to any disclaimer, the term of this patent is extended or adjusted under 35 U.S.C. 154(b) by 0 days.

(21) Appl. No.: 15/274,010

(22) Filed: Sep. 23, 2016

(65) Prior Publication Data

US 2017/0089083 A1 Mar. 30, 2017

Related U.S. Application Data

(60) Provisional application No. 62/284,291, filed on Sep. 25, 2015.

(51) Int. Cl.

| | |
|---|---|
| ***E04D 1/20*** | (2006.01) |
| ***E04D 1/34*** | (2006.01) |
| ***E04D 1/30*** | (2006.01) |
| ***E04G 23/02*** | (2006.01) |
| ***E04D 1/26*** | (2006.01) |

(Continued)

(52) U.S. Cl.

CPC ..... *E04G 23/0281* (2013.01); *E04D 1/18* (2013.01); *E04D 1/265* (2013.01); *E04D 1/30* (2013.01); *E04D 1/34* (2013.01); *E04D 1/3402* (2013.01); *E04D 1/3405* (2013.01); *E04D 1/36* (2013.01); *E04D 3/365* (2013.01); *E04D 3/3608* (2013.01); *E04D 3/40* (2013.01); *E04D 1/20* (2013.01); *E04D 2001/308* (2013.01); *E04D 2001/3488* (2013.01)

(58) Field of Classification Search

CPC ..... E04G 23/0281; E04D 1/30; E04D 1/36; E04D 1/3402; E04D 1/3405; E04D 2001/308; E04D 2001/3488; E04D 1/20; E04D 1/18; E04D 1/22; E04D 1/26; E04D 1/34; E04D 2001/3444; E04D 2001/3452; E04D 5/04; E04D 1/00; E04D 3/30

See application file for complete search history.

(56) References Cited

U.S. PATENT DOCUMENTS 3,133,377 A * 5/1964 Jackson ..... E04D 13/04 52/11
4,010,590 A * 3/1977 Reinke ..... E04D 1/06 52/533

(Continued)

*Primary Examiner* — Phi D A
(74) *Attorney, Agent, or Firm* — Ridout & Maybee LLP

(57) ABSTRACT

The present concept is a method of roofing a bare roof deck. Asphalt shingles and metal flashings are applied to a wood deck of a roof before flashings and asphalt capping are applied. Metal panels are applied overtop of existing asphalt roof, thereby creating a metal overlay configured such that substantially all of the asphalt shingles are covered with a metal panel for preventing further degradation of asphalt components by shielding from sunlight, UV rays, excessive moisture, snow, wind, ice and fire. No further flashings are installed thereby the metal panel overlay creates a semi-watertight seal wherein the metal panel overlay together with asphalt roof is adapted to create a watertight seal. The present concept is also a method for roofing an existing asphalt shingled roof where metal panels are applied overtop the existing asphalt shingled roof. This creates a metal overlay that covers substantially all of the asphalt shingles for preventing further degradation of asphalt components, and provides a method of preserving an asphalt shingled roof.

3 Claims, 15 Drawing Sheets

(51) Int. Cl.

| | |
|---|---|
| ***E04D 3/36*** | (2006.01) |
| ***E04D 3/365*** | (2006.01) |
| ***E04D 3/40*** | (2006.01) |
| ***E04D 1/18*** | (2006.01) |
| ***E04D 1/36*** | (2006.01) |

(56) References Cited

U.S. PATENT DOCUMENTS 4,099,356 A * 7/1978 Graham ..... E04D 3/30 52/276
4,120,132 A * 10/1978 Kendrick ..... E04B 7/205 52/478
4,135,342 A * 1/1979 Cotter ..... E04D 13/165 52/406.1
4,213,282 A * 7/1980 Heckelsberg ..... E04D 3/362 52/404.2
4,445,305 A * 5/1984 Orie, Sr. ..... E04D 13/165 52/309.9
4,446,665 A * 5/1984 Berger ..... E04D 3/3602 52/407.4
4,476,658 A * 10/1984 Johnstone ..... E04D 3/366 52/395
4,506,486 A * 3/1985 Culpepper, Jr. ..... E04D 1/28 52/529
5,022,314 A * 6/1991 Waggoner ..... E04D 13/152 454/250
5,165,211 A * 11/1992 Ottoson ..... E04D 1/28 52/548
5,394,672 A * 3/1995 Seem ..... B32B 15/04 52/591.1
6,907,701 B2 * 6/2005 Smith ..... E04D 3/30 52/309.8
7,174,686 B1 * 2/2007 Legband ..... E04D 3/3608 52/462
7,574,839 B1 * 8/2009 Simpson ..... E04D 3/362 52/520
7,818,937 B2 * 10/2010 Monsieur ..... E04D 3/363 52/525
7,987,647 B2 * 8/2011 Rymell ..... E04D 3/3608 52/408
8,713,864 B1 * 5/2014 Smith, Jr. ..... E04D 3/28 52/200
8,887,464 B1 * 11/2014 Smith, Jr. ..... E04D 3/28 52/336
9,404,262 B1 * 8/2016 Smith, Jr. ..... E04D 3/30
9,631,368 B1 * 4/2017 Heo ..... E04D 13/004
2003/0041530 A1 * 3/2003 Hofmann ..... E04D 1/36 52/90.1
2004/0035274 A1 * 2/2004 Fasnacht ..... B23Q 9/0028 83/468.3
2005/0086890 A1 * 4/2005 Verkamp ..... E04D 3/3608 52/518
2009/0013620 A1 * 1/2009 West ..... E04D 13/1476 52/198
2010/0227103 A1 * 9/2010 Hohmann, Jr. ..... C09J 7/0296 428/41.8
2010/0263661 A1 * 10/2010 Faulkner ..... E04D 3/362 126/623
2011/0047927 A1 * 3/2011 Nark ..... E04D 13/103 52/741.1

* cited by examiner

SYSTEM FOR RE-ROOFING ASPHALT SHINGLED ROOFS

The present application claims priority from U.S. provisional patent application 62/284,291 filed Sep. 25, 2015 under the title SYSTEM FOR RE-ROOFING ASPHALT SHINGLED ROOFS to Vince Guerra.

FIELD OF THE INVENTION

The present concept relates to roofing systems and re-roofing systems and more particularly relates to a system for re-roofing asphalt shingled roofs with a metal panel.

BACKGROUND OF THE INVENTION

There is a huge gap between the price of asphalt singles and all other roofing products. Asphalt singles are usually one third to one tenth lower in price than other alternatives out there, including steel roofing. This has led to asphalt shingles dominating the North American roofing industry for the past 150 years. Metal roofing has been rising in popularity more recently; however growth in the use of metal roofing systems has stagnated due to the high cost involved with roofing and/or re-roofing with a metal roof.

The present concept is a system for re-roofing asphalt shingled roofs using a metal panel that can be installed at a price competitive to re-roofing with asphalt shingles. The present system uses the existing roof as an integral part of the new roof thereby avoiding the cost of stripping and disposal of the existing shingles.

The inventor was granted U.S. Pat. No. 8,241,728 on Aug. 14, 2012, for a composite metal and asphalt shingle construction. This was an attempt to provide a low cost high performance roof that provided longer life than a conventional asphalt shingled roof.

SUMMARY OF THE INVENTION

The present invention is a method of roofing a bare roof deck, the method comprises the steps:

a) apply asphalt shingles and metal flashings to a wood deck of a roof;

b) apply flashings selected from among: edge drip for edges and gable ends, metal valleys, and step flashing for wall to roof junctions, c) apply asphalt capping selected from among ridges and hips;

d) fasten metal panels overtop of existing asphalt roof, thereby creating a metal overlay configured such that substantially all of the asphalt shingles are covered with a metal panel for preventing further degradation of asphalt components by shielding from sunlight, UV rays, excessive moisture, snow, wind, ice, and fire;

e) no further flashings are installed thereby the metal panel overlay is configured to create a semi-watertight seal wherein the metal panel overlay together with asphalt roof is adapted to create a watertight seal.

Preferably further including the step of:

a') applying an underlayment to the wood roof deck as required;

Preferably further replacing step d) with the following step of:

d') fasten metal panels overtop of existing asphalt roof configured to leave small gaps at positions selected from among: ridges or hips, and valleys and wall junctions, where small amounts of water may seep through, thereby creating a metal overlay which is configured such that substantially all of the asphalt shingles are covered with a metal panel for preventing further degradation of asphalt components by shielding from sunlight, UV rays, excessive moisture, snow, wind, ice and fire.

Preferably wherein the small gaps do not exceed 0.5" (inches) in width.

Preferably wherein the small gaps do not exceed 0.0625" (inches) in width.

Preferably further including the step of:

a) bending the metal panels to create an overlap thereby maximizing the water shedding ability of the metal panels and minimizing the gaps.

Preferably further including the step of:

a) Adding decorative components to visually conceal gaps thereby maximizing the water shedding ability of the metal panels and minimizing the gaps.

The present invention is also a method of roofing an existing asphalt shingled roof the method comprises the steps:

a) apply metal panels overtop of existing asphalt roof, thereby creating a metal overlay configured such that substantially all of the asphalt shingles are covered with a metal panel for preventing further degradation of asphalt components by shielding from sunlight, UV rays, excessive moisture, snow, wind, ice, and fire;

b) no further flashings are installed thereby the metal panel overlay creates a semi-watertight seal wherein the metal panel overlay together with asphalt roof is adapted to create a watertight seal.

Preferably further replacing step a) with the following step of:

a') apply metal panels overtop of existing asphalt roof configured to leave small gaps at positions selected from among: ridges or hips, and valleys and wall junctions, where small amounts of water may seep through, thereby creating a metal overlay configured such that substantially all of the asphalt shingles are covered with a metal panel for preventing further degradation of asphalt components by shielding from sunlight, UV rays, excessive moisture, snow, wind, ice and fire.

Preferably wherein the small gaps do not exceed 0.5" (inches) in width.

Preferably wherein the small gaps do not exceed 0.0625" (inches) in width.

The present invention is also a method of extending the life of an existing asphalt shingled roof the method comprises the steps:

a) inspecting the existing asphalt roof and repairing any damaged areas that may allow excessive water penetration into the roof;

b) fasten metal panels overtop of an existing asphalt roof, thereby creating a metal overlay configured such that substantially all of the asphalt shingles are covered with a metal panel for preventing further degradation of asphalt components by shielding from sunlight, UV rays, excessive moisture, snow, wind, ice, and fire;

c) no further flashings are installed thereby the metal panel overlay creates a semi-watertight seal wherein the metal panel overlay together with asphalt roof is adapted to create a watertight seal;

BRIEF DESCRIPTION OF THE DRAWINGS

The present concept will be described by way of example only with reference to the following drawings in which.

DETAILED DESCRIPTION OF THE PREFERRED EMBODIMENTS

Definitions

Figure 1:
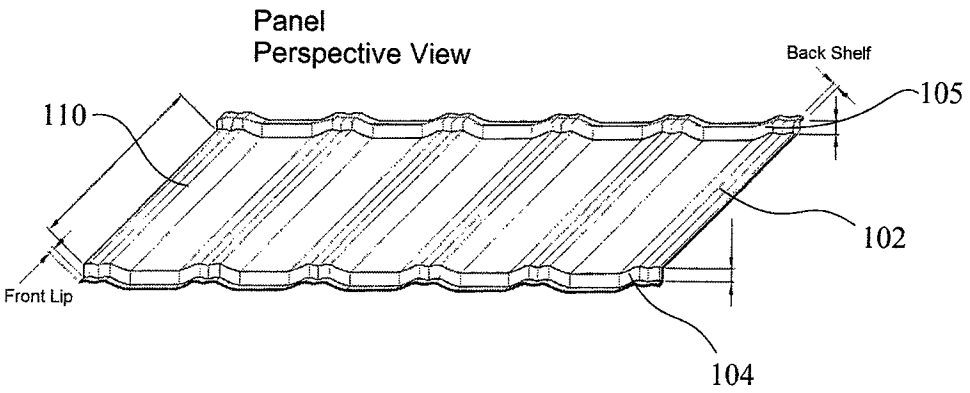
FIG. 1 is a top perspective view of a metal roofing panel.

Asphalt Shingled Roof: A roof constructed of well-known materials normally containing some bitumen or tar and commonly referred to in the industry as: asphalt shingles, laminate shingles, architectural shingles, fiberglass shingles and composite shingles. Another popular roofing system competing with Asphalt Shingled Roofs is metal panel roofing which is normally constructed of galvanized painted steel.

Watertight: in this patent refers to the water penetration resistance obtained from a well installed asphalt shingled roof. In practice these roofs are normally not completely waterproof but offer a high degree of water tightness.

The present concept a system for re-roofing asphalt shingled roofs is depicted in FIG. 1 through 4 and described here below:

The major components of the system include metal panel 102 which includes a front lip 104, a rear lip 105, and a centre section 110.

Figure 2:
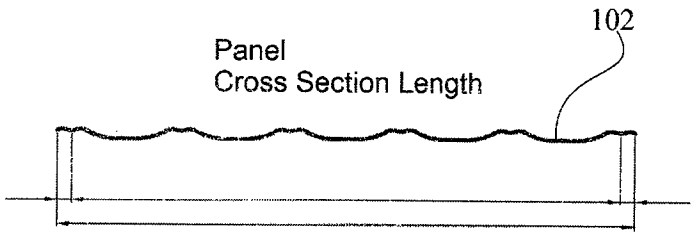
FIG. 2 is a transverse cross-sectional view of the panel shown in FIG. 1.

FIG. 2 shows in cross sectional view, metal panel 102 having an ornamental form which is aesthetically pleasing to the eye.

Figure 3:
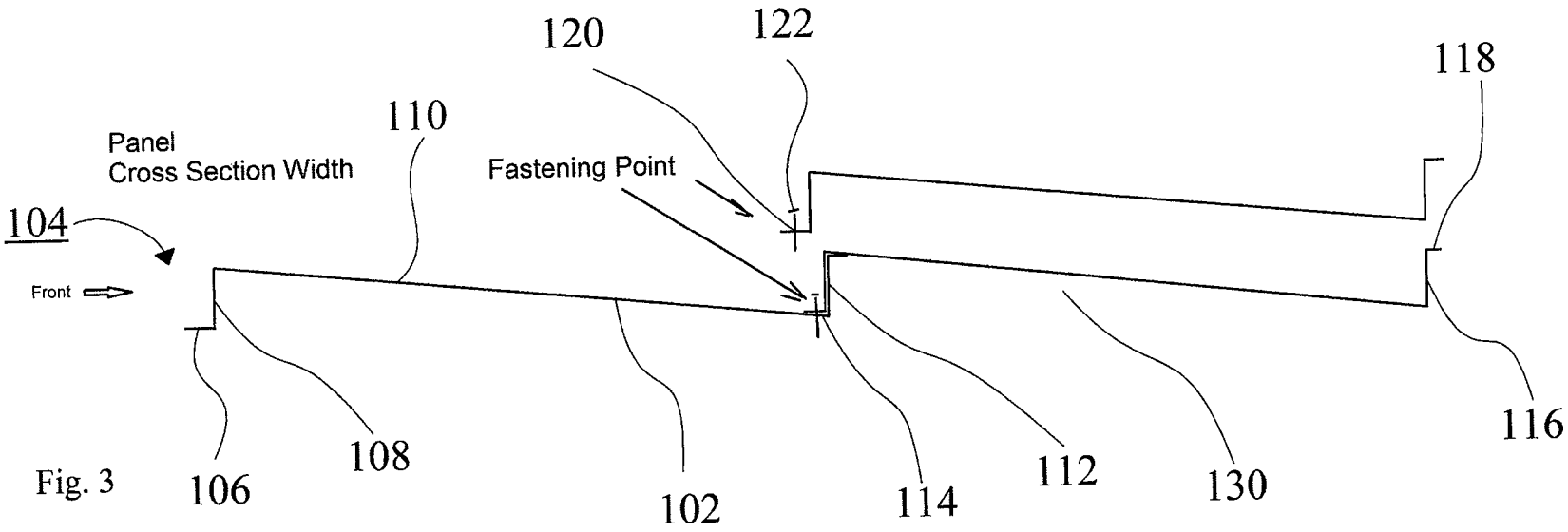
FIG. 3 is a cross sectional view of a number of panels 102 showing the overlap in installation of two panels together with a fastening point.

FIG. 3 shows the deployment of multiple metal panels shown with an overlap 112 indicating how these panels would be installed when overlapping onto the other in a typical re-roofing scenario.

Figure 4:
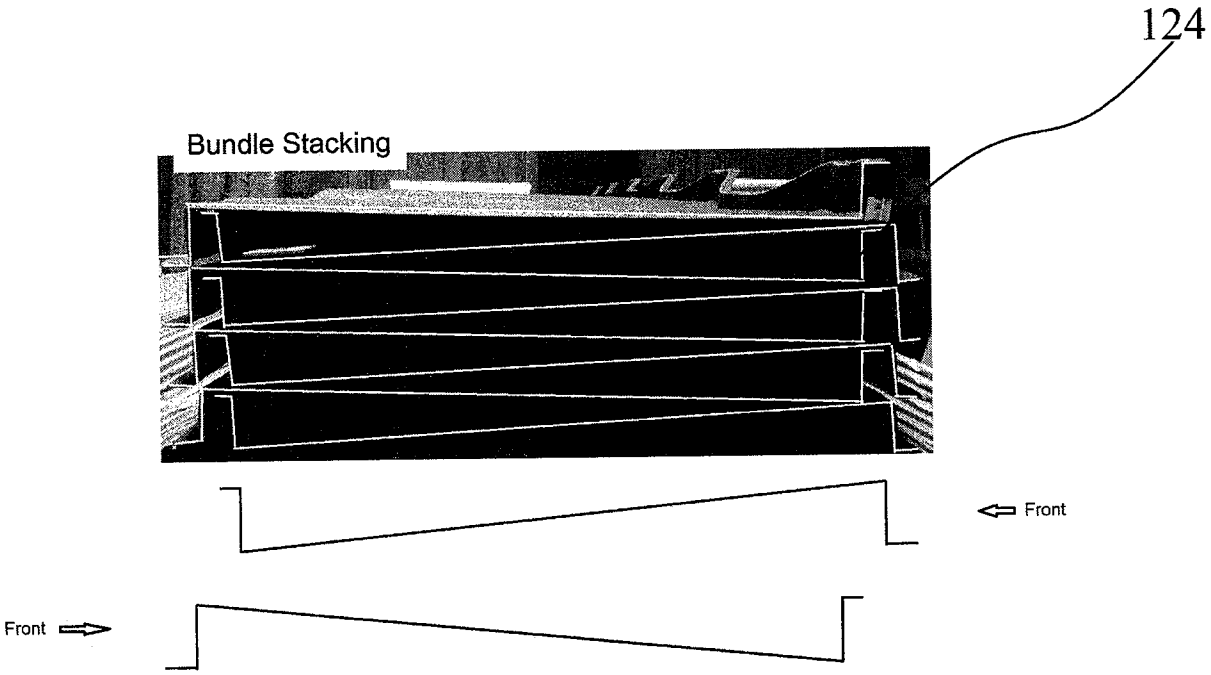
FIG. 4 is a photograph of a nesting arrangement used for nesting the panel shown in FIGS. 1 through 3.

FIG. 4 is a photograph showing a number of metal panels 102 nested together.

DETAILED DESCRIPTION OF A PREFERRED EMBODIMENT

Metal panel 102 includes the front lip 104 which has a front vertical portion 108 and a front horizontal portion 106.

Panel 102 further includes a rear lip 105 which includes a rear vertical portion 116 and a rear horizontal portion 118.

The panels are placed together as shown in FIG. 3 during the installation of a re-reroofing process showing overlap 112 as shown in FIG. 3.

The panels are attached to the roof at a fastening point 120 with a fastener 122 which typically could be a nail or screw.

The reader will note that the front lip is downwardly extending whereas the rear lip is upwardly extending allowing for the fastening point 120 as shown in the diagrams.

By having a downwardly extending vertical front portion 108 and an upwardly extending rear vertical portion 116 the panel creates an air passageway 130 between the existing roof and the panel thereby allowing for adequate ventilation.

This panel would use the existing roof as an integral part of a new roof. Minimal amount of flashing is required since a substantial portion of the existing flashing on the existing roof is utilized in the re-roofing process. This panel can be installed with a complicated double strapping system but it can also be installed with a simple no strapping and no flashing system when going over an existing asphalt roof.

Method of Installation of Metal Panels Over Asphalt Shingled Roof

The inventor has spent many years in the roofing industry observing traditional asphalt shingle reroofing which normally consists of stripping of the old roof to the point where the original wood deck is exposed and disposing of the stripped shingles and flashings which normally ends up in landfilled sites. The inventor discovered unexpectedly that the unexposed portion of the old roof, namely that part of the shingle which is covered by the overlapping adjacent shingle, is normally found to be in close to pristine condition and almost perfectly preserved under the protection of the overlapping part of the shingle, which may have degraded over time.

The inventor has also determined that most roofs that are reroofed are still perfectly waterproof and that the roof in most cases are being replaced for aesthetic or look appeal reasons and not usually for reasons that the roof is leaking. In other words, the look of the roof, namely, degradation of the surface of the shingles and/or curling and/or discolouration of the roof is normally the trigger for causing a reroof rather than the roof having been degraded to the point where it is now leaking. In other words, an old or weathered asphalt roof, which may have degraded in appearance is still perfectly waterproof and the inventor has noticed to his surprise that those portions of the asphalt roof that are not exposed to direct sunlight, namely the overlapping covered portion of the shingle as well as the flashings and underlayment, is normally found to be in almost pristine condition even after 20 and 30 years of weathering.

Used shingles and disposal of used shingles that are stripped from existing roofs creates a huge burden to the landfill sites across the world and in particular North America where asphalt shingled roofing is extremely popular. Therefore, there is a need to come up with a roofing system that eliminates or minimizes the amount of shingles entering into the landfill disposal sites, that increases the life of the roof, extends the complete reroofing cycle to beyond 50 years, and yet maintains an aesthetically appealing look.

The inventor has discovered that in order to meet these objectives, a combination of asphalt roofing technology and steel roofing technologies could be combined in a new method and system of roofing that unexpectedly produces a serviceable roof. The present concept is completely counterintuitive to present day thinking. It is currently considered unfeasible to simply place a roof, which is not watertight, over top of an existing "spent" asphalt shingled roof, to produce a roof which is serviceable for many more years.

Current thinking in regard to asphalt roofs which have come to the end or near end of their life, which is normally somewhere between 15 and 30 years, is that roof is either replaced with a new completely watertight roof installed overtop of the existing roof or the existing must be stripped down to the wood deck and re-shingled as it would have been in the first instance. The presently accepted new roof may be an asphalt roof, which is installed with all new flashings including edge drip, step flashing as well as metal valleys and asphalt capping or a metal paneled roof, however once again the metal paneled roof would be installed with a whole variety of flashings or onsight custom brake fabrications including edge drip, step flashing, special metal valley panels and special roof capping panels in order to complete and make the new roof water tight.

It is currently inconceivable to those skilled in the art that a new metal roof can be installed without any new flashings at all.

The concept of having a roof with zero flashings was first discovered by the inventor when he realized that his previous invention described in U.S. Pat. No. 8,241,728 by Vince Guerra, titled Stone, Metal and Tar Laminate for Exterior Cladding due to the current high cost of constructing combined metal and asphalt materials into a single laminate structure. The inventor discovered contrary to the present considerations that all the materials which are unexposed under the existing asphalt roof, namely that portion of the shingle which is overlapped, the underlayment, the step flashings, the metal valleys and the edge drips are all in close to pristine condition, even after 25 years of service and are easily serviceable for another 20 years and some cases even longer provided that most of exposed portions could be protected from further degradation.

The present concept is a method of reroofing an existing asphalt roof using zero flashings.

Figure 5:
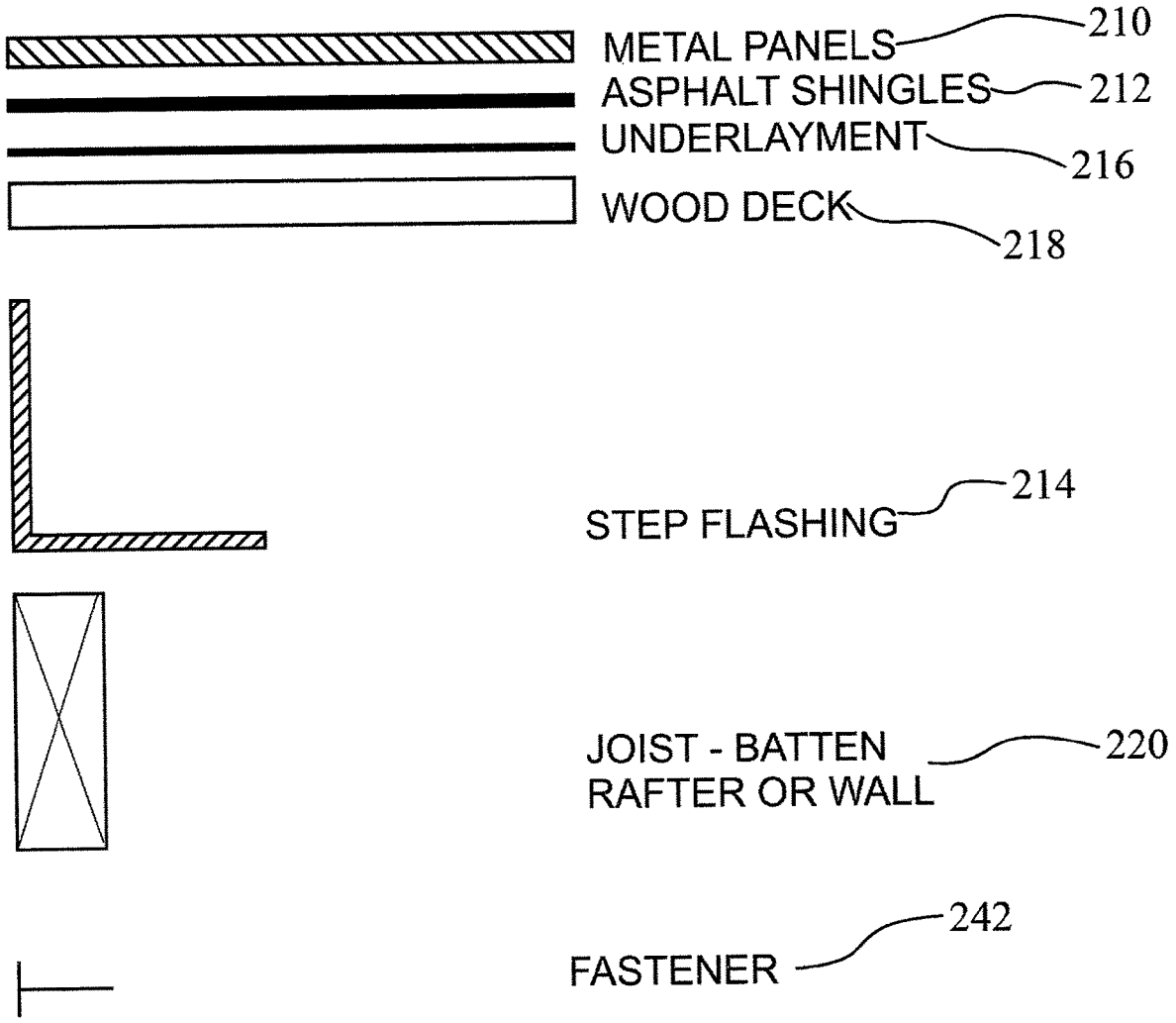
FIG. 5 is a legend depicting the various materials shown.

FIG. 5 is a legend showing the shading used for the various materials shown in most of the following drawings, namely metal panels 210, asphalt shingles 212, underlayment 216, wood deck 218, step flashing 214, joist (batten, rafters or wall) 220 and fasteners 242. The reader can refer to the legend in FIG. 5 to determine the material shown and depicted in the following drawings.

Figure 6:
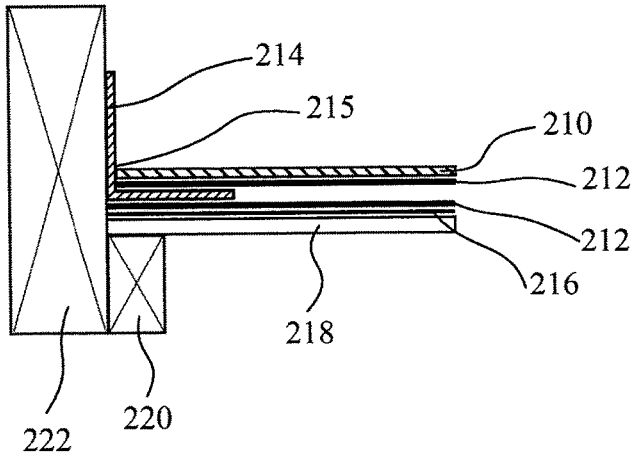
FIG. 6 is a cross sectional view of the roof wall configuration.
Figure 7:
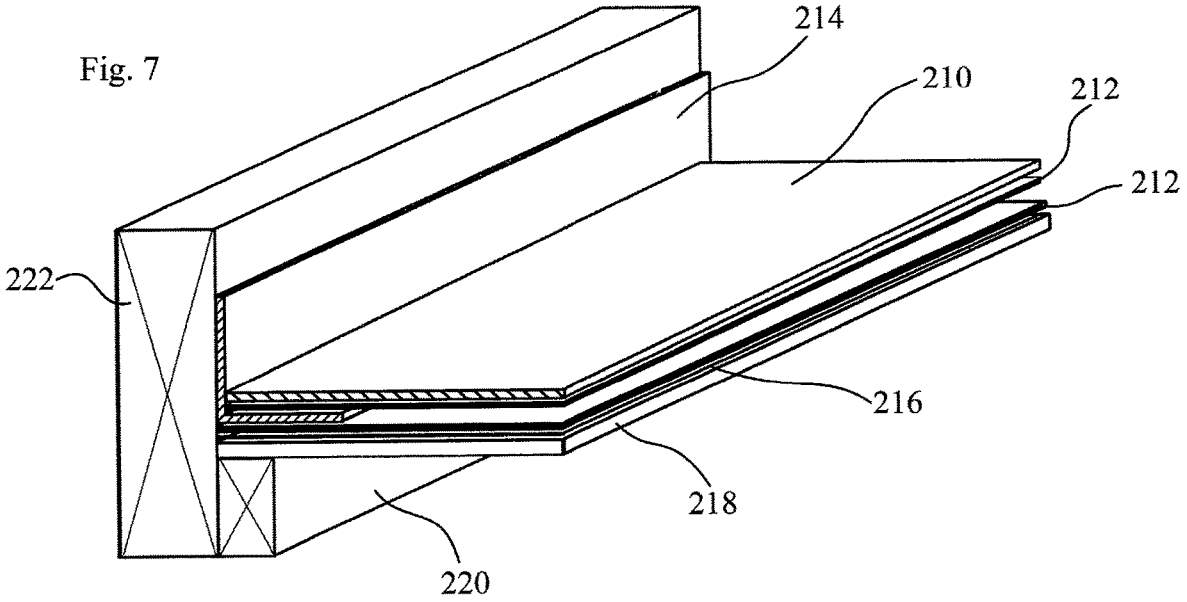
FIG. 7 is a top perspective view of the roof wall configuration.
Figure 8:
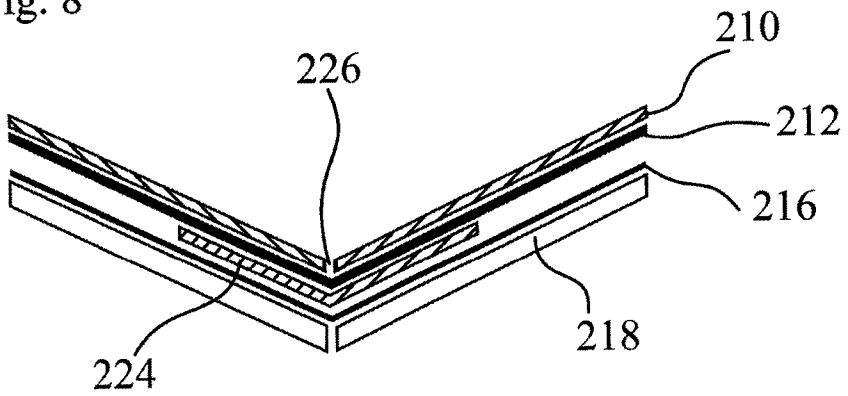
FIG. 8 is a cross sectional view of the valley configuration.
Figure 9:
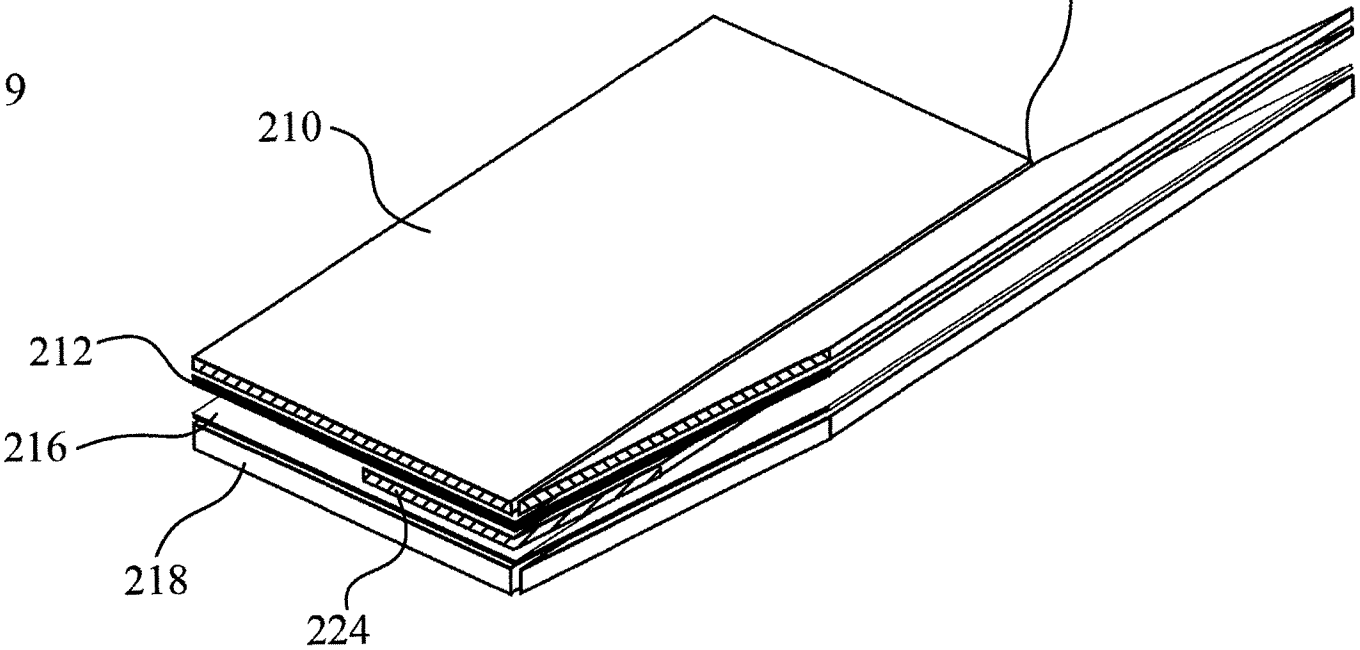
FIG. 9 is a top perspective view of the valley configuration.
Figure 10:
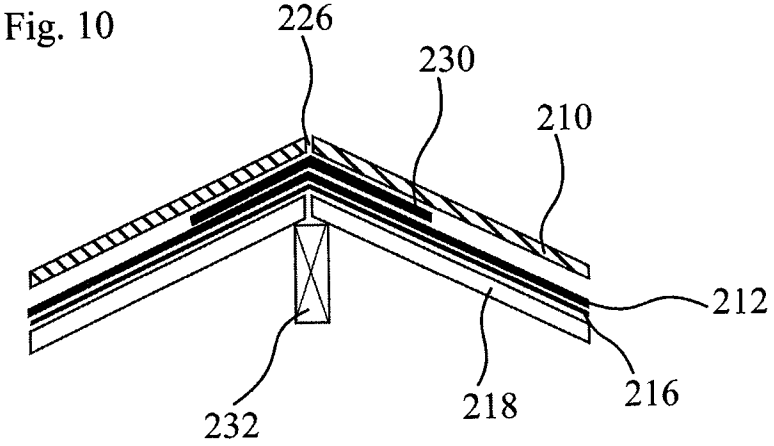
FIG. 10 is a cross sectional view of the ridge/hip configuration.
Figure 11:
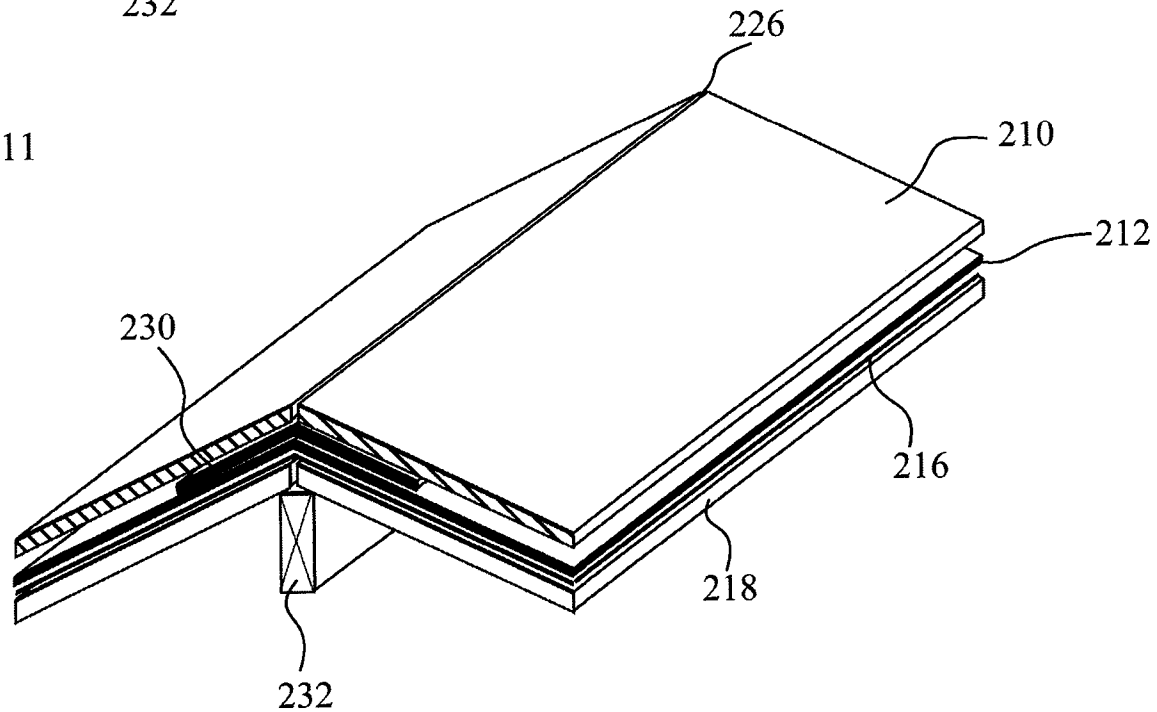
FIG. 11 is a top perspective view of the ridge/hip configuration.

The method of reroofing asphalt shingled roofs using metal panels is shown in various critical configurations in the attached drawings, namely FIGS. 6 and 7 show roof wall configuration; FIGS. 8 and 9 show valley configuration; and FIGS. 10 and 11 show ridge and or hip configuration.

Figure 12:
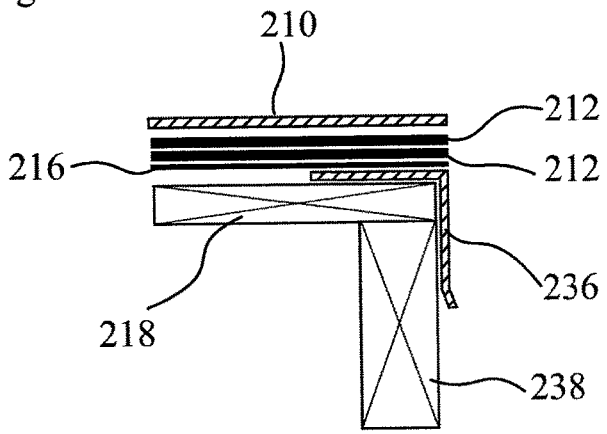
FIG. 12 is a cross sectional view of the gable end configuration.
Figure 13:
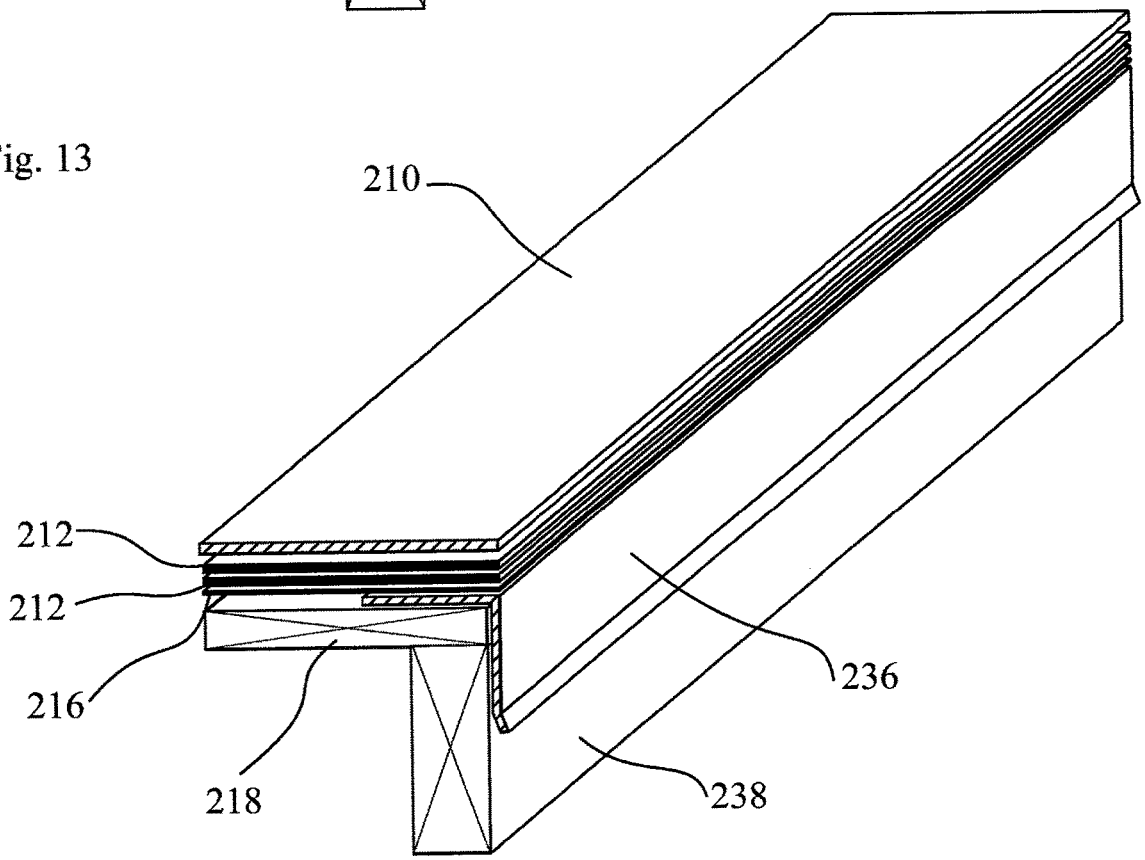
FIG. 13 is a top perspective view of the gable end configuration.
Figure 14:
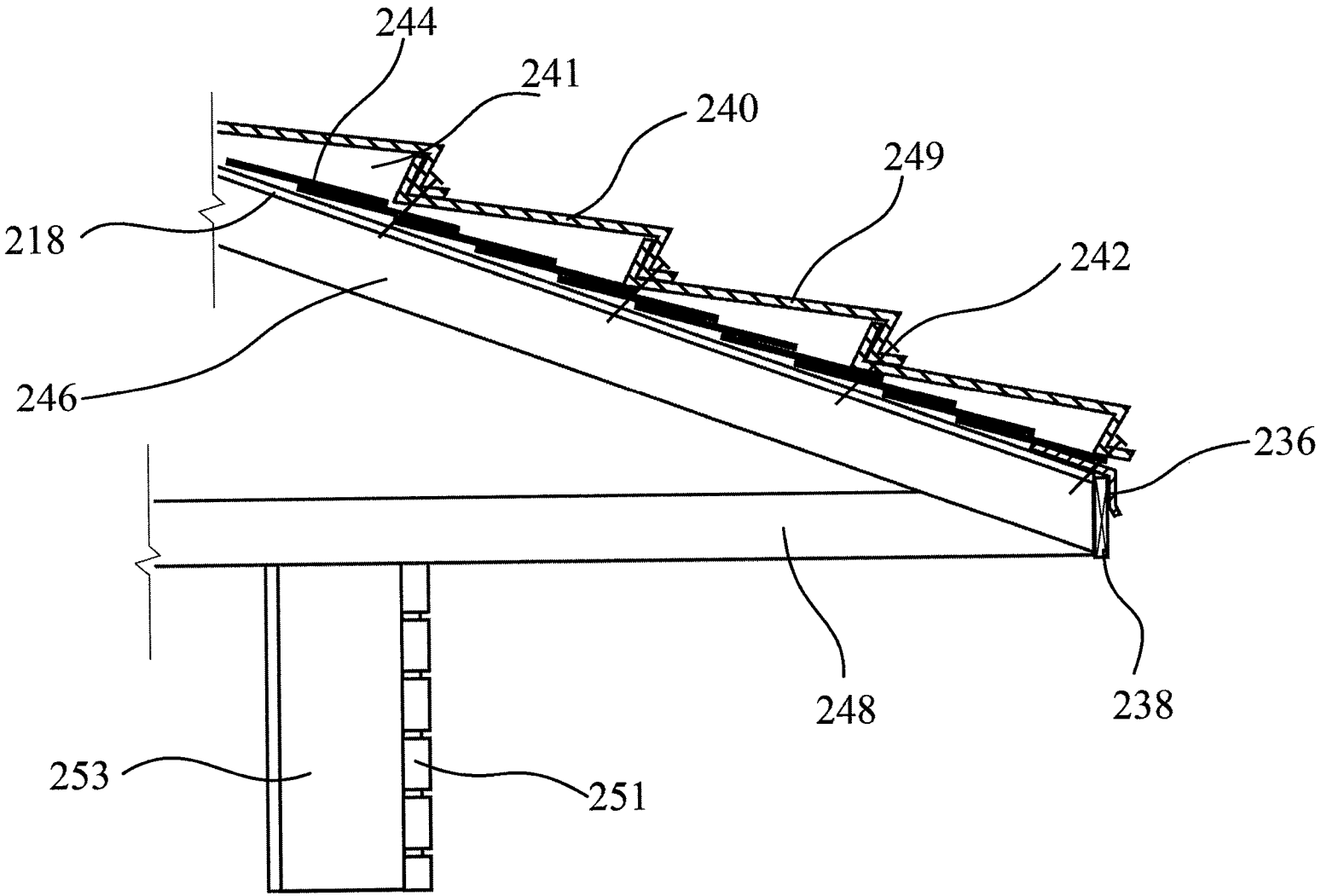
FIG. 14 is a cross sectional view of a typical roof at the cave or drip edge portion of the roof.

FIGS. 12 and 13 show a gable end configuration and FIG. 14 shows an eave or edge configuration.

Figure 15:
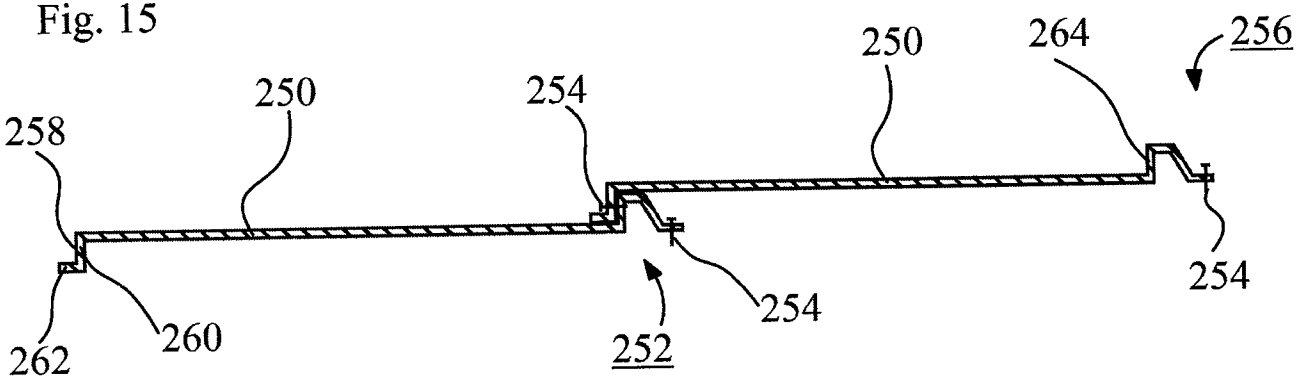
FIG. 15 is a cross sectional view of a typical metal panels.
Figure 16:
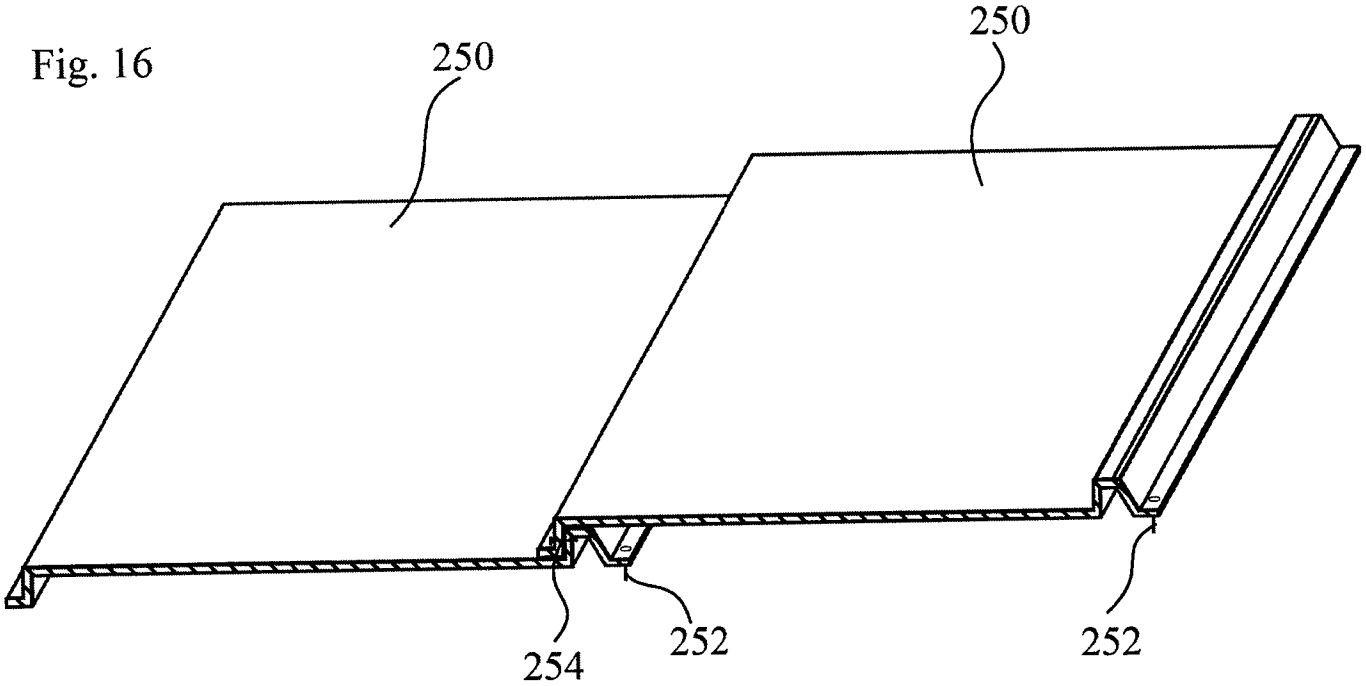
FIG. 16 is a top perspective view of a typical metal panels.

FIGS. 15 and 16 show a typical metal panel that can be used with this system however 17, 18 and 19 show different metal panel configurations and systems which could equally be used with the current method of reroofing asphalt shingled roofs with metal panels.

Figure 17:
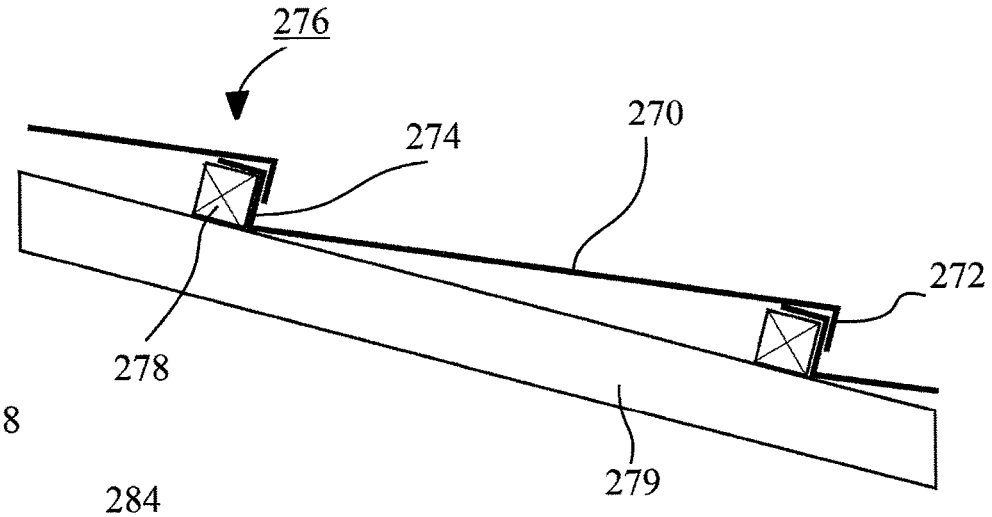
FIG. 17 is a cross sectional view of a metal panel in use with battens.

FIG. 17 shows a metal panel which is used together with battens 278.

Figure 18:
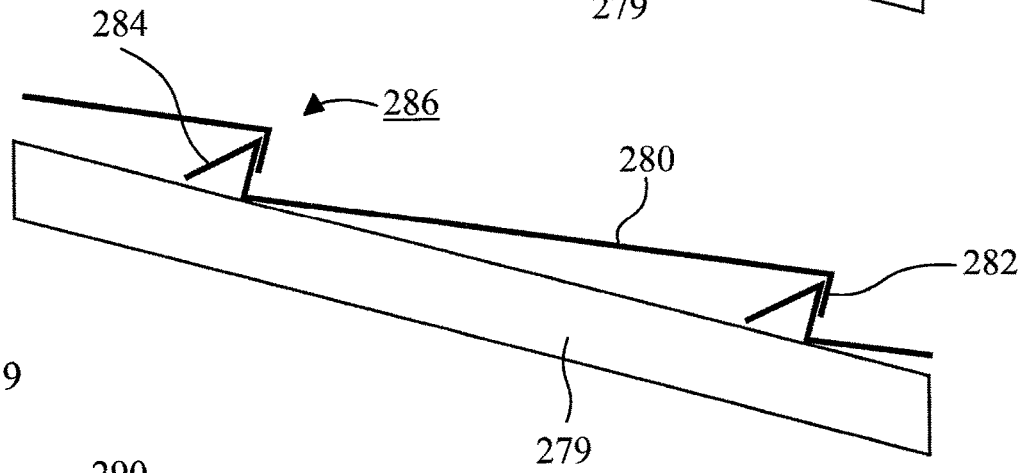
FIG. 18 is a cross sectional view of a metal with built in battens portion.

FIG. 18 shows a metal panel which has a built in battens portion, namely 284.

Figure 19:
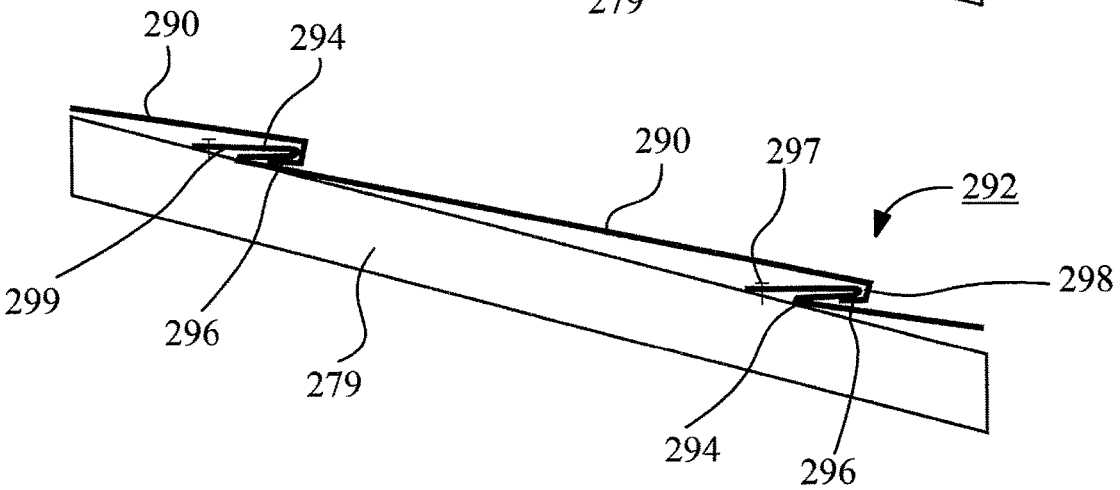
FIG. 19 is a cross sectional view of a metal panel with a tongue and groove locking mechanism.

FIG. 19 shows a metal panel which can be nailed directly to the existing roof and has a tongue and groove locking mechanism depicted at 292.

Referring now to FIGS. 6 and 7 depicting a roof to wall configuration, the existing roof components consist of the wood deck 218, the underlayment 216, roof shingles 212, step flashing 214, joists 220, and wall 222. Overtop of this roof, one can place metal panels 210 as shown in FIG. 6. There might be a slight corner gap at 215 where the metal panel 210 butts with the step flashing 214.

Referring now to FIGS. 8 and 9 which depict a valley configuration, in which the existing roof normally is comprised of the wood deck 218, underlayment 216, metal valley 224, the existing asphalt shingles 212, which in this case are shown as continuously across the metal valley 224 but also may include a significant gap between one side of the valley and the other. On top of this existing roof, one could place metal panels 210, having a metal panel gap 226 as depicted in FIG. 8.

FIGS. 10 and 11 show a ridge and/or hip configuration in which the existing roof consists of the wood deck 218, joist 232, the underlayment 216, asphalt shingles 212, and asphalt capping 230. Over top of this existing roof, one could place a metal panel 210 which would include a metal panel gap 226 as shown in FIG. 10. Referring now to FIGS. 12 and 13 which shows the gable end configuration. The existing metal roof would include the fascia board 238, the wood deck 218, the drip edge 236, the underlayment 216, and the existing asphalt shingles 212. Over top of this existing roof, one is able to place new metal panels 210, which cover the shingles 212 or even slightly before or beyond the existing shingle edge.

Referring now to FIG. 14, which shows a cross sectional view of a typical roof at the eave or drip edge portion of the roof.

A typical roof construction includes a wall 253, brick 251, a horizontal joist 248, an incline joist 246, a wood deck 218, existing asphalt shingles 244, a fascia board 238 and an existing drip edge 236. It may also include, however not shown in the diagram, an underlayment 216 underneath the asphalt shingles 244.

Over top of this existing roof, one is able to place metal panels 240 creating a metal panel overlay 249 (also referred to as metal overlay), using fasteners 242. The reader will note that this creates airspaces 241, allowing air movement between the metal panels and the asphalt shingles.

FIG. 14 may in fact depict a gable end and the reader will note that at a gable end, the airspace 241 is completely open at the side of the gable end allowing movement of air through the metal panel airspace 241.

FIGS. 15 and 16 show a metal panel 250, which includes a lip 258 on one end and a built-in batten 256 on the other end. The lip includes a horizontal leg 262 and a vertical leg 260 and the built-in batten includes a vertical section 264. Adjacent panels overlap 252 as shown in FIGS. 15 and 16 and are attached using fasteners such as screws 254.

FIGS. 17, 18 and 19 show three different panel configurations. The metal panels are shown in solid black lines and identified as metal panels. FIG. 17 shows a metal panel 270, which is used in conjunction with the joist 279, a battens 278 and has a lip 272, a back shelf 274 and an overlap section 276.

Metal panel 280 has a built-in batten portion 284, a lip 282 and a back shelf 286.

Figure 20:
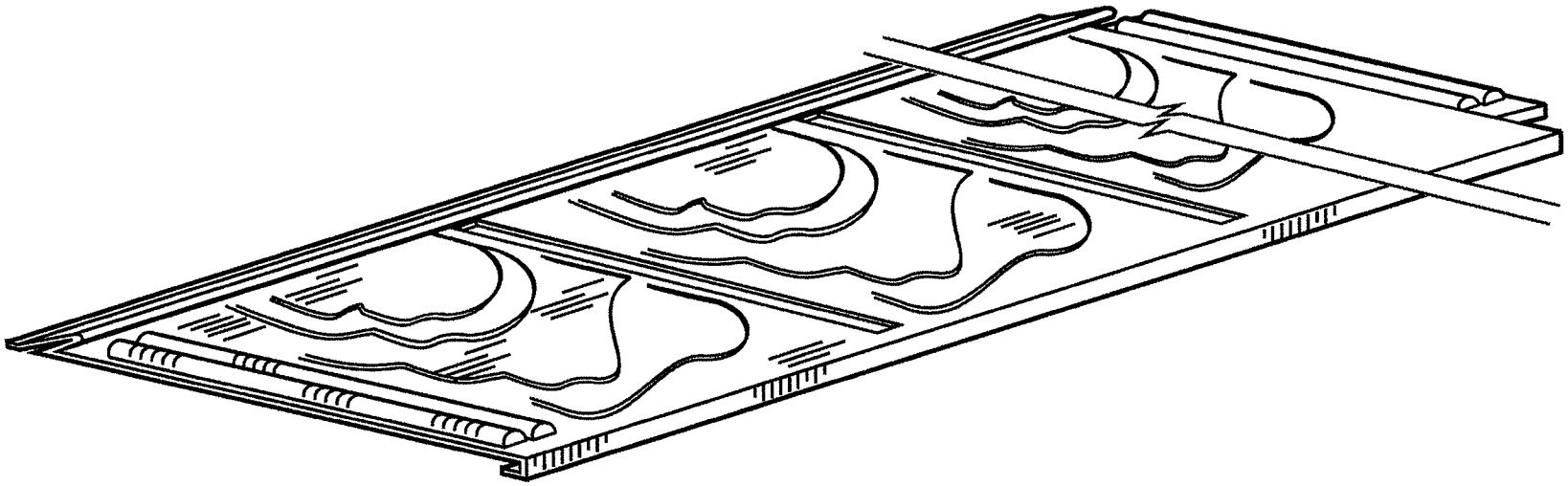
FIG. 20 is a top perspective view of a typical metal panel.

Metal panel 290 is of the tongue and groove configuration, having a tongue and grove interlocking mechanism 292 with a tongue end 298 and a flange portion 299 with a double fold end 294, which includes the tongue 296 and is fastened to the roof with the fastener 297 at the double fold end 294, which defines a groove for accepting the tongue 296. Metal panel 290 is fastened directly to the asphalt shingled roof without need for battens. A typical metal panel 290 is shown in FIG. 20 in perspective view. This metal panel is also known as a hidden fastener system.

Figure 23:
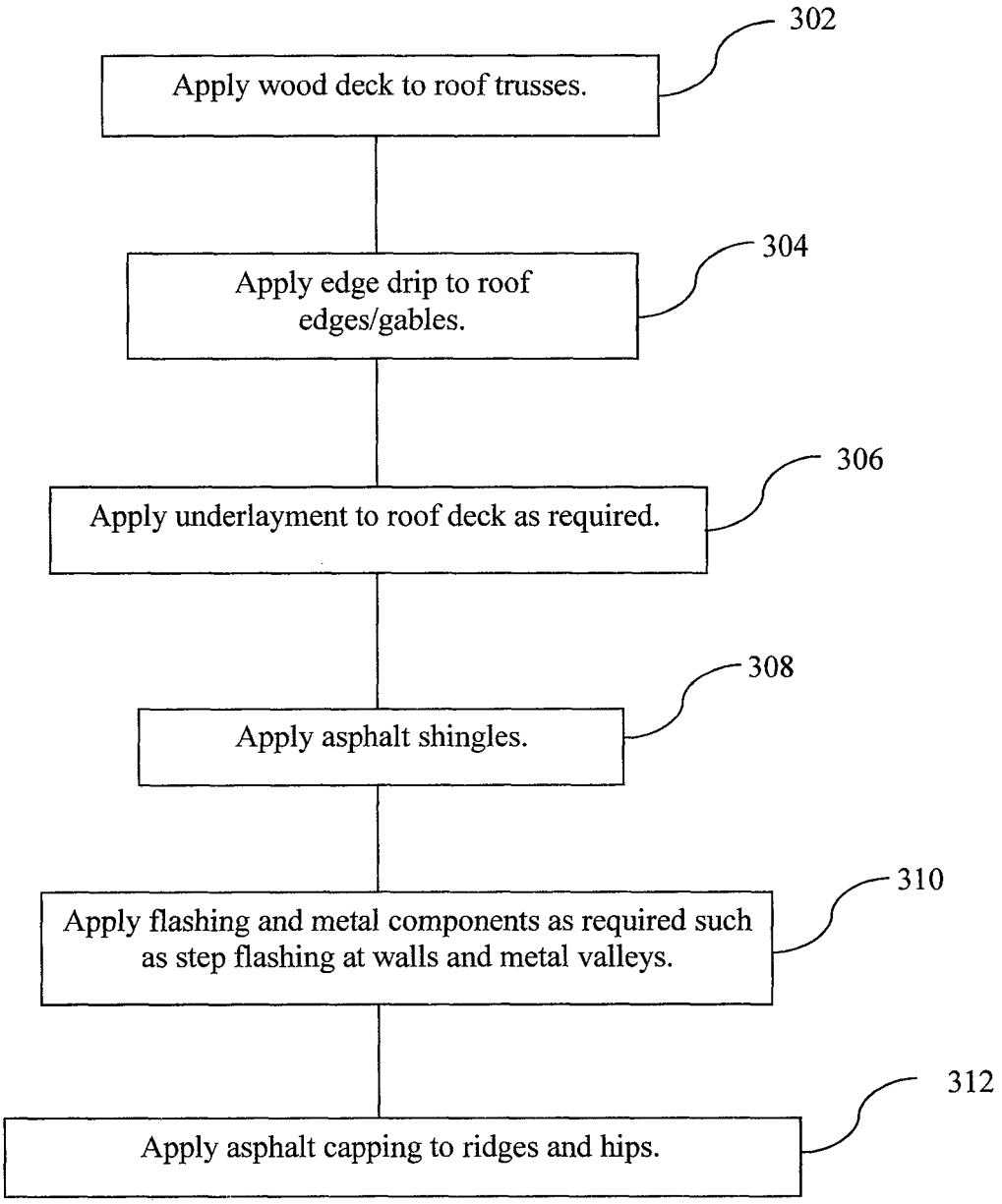
FIG. 23 is a flow chart describing the method of roofing and reroofing asphalt shingled roofs using metal panels.
Figure 24:
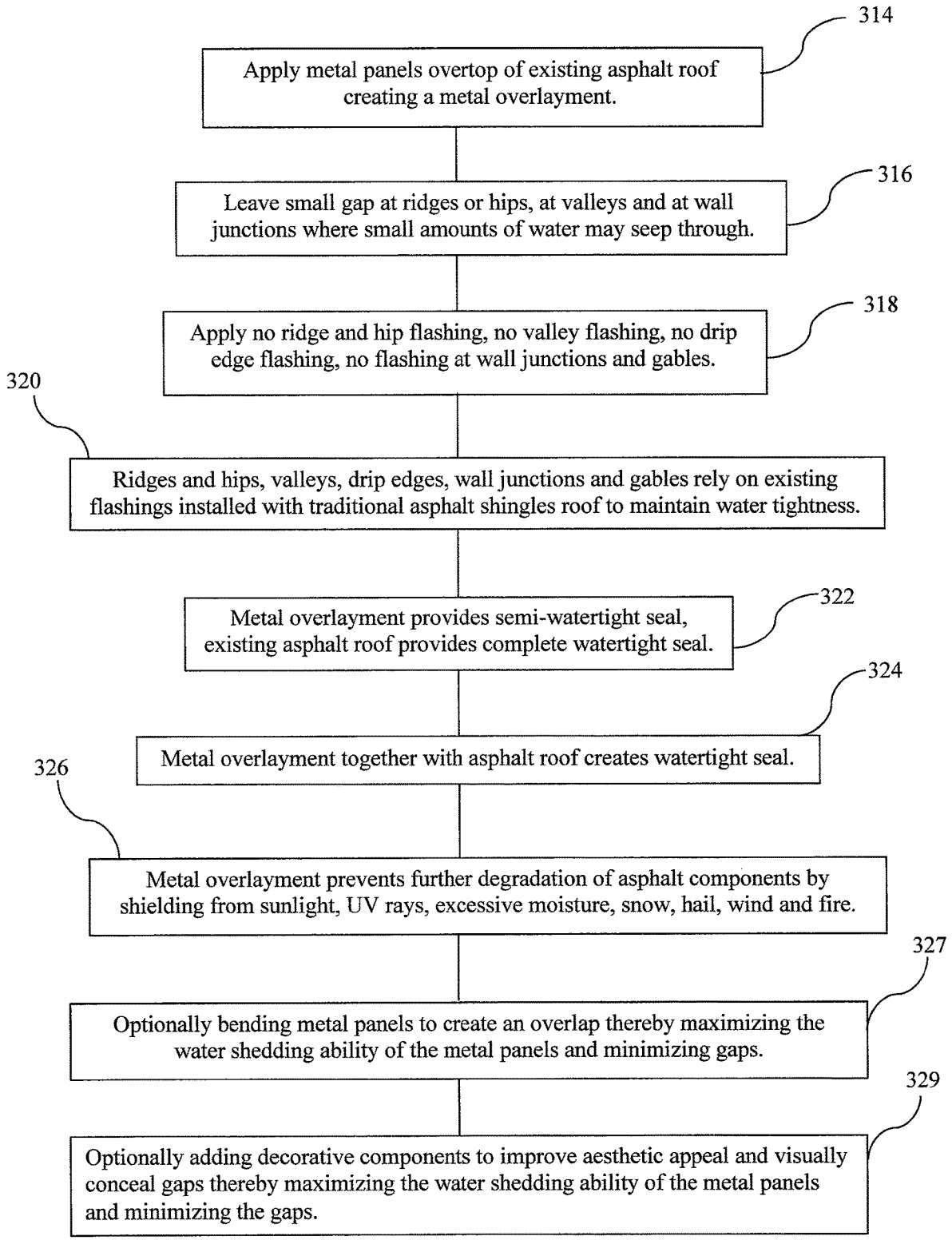
FIG. 24 is a flow chart describing the additional steps for reroofing an existing asphalt shingled roof with metal panels.

Referring now to FIGS. 23 and 24, which in flow chart fashion describe the method of roofing and reroofing asphalt shingled roofs using metal panels.

FIG. 23 deals with roofing with asphalt shingled roofs, either applying a brand new roof or reroofing and includes the following:

Apply wood deck to the roof trusses: 302

Apply edge drip to roof edges/gables: 304

Apply underlayment to roof deck as required: 306

Apply asphalt shingles: 308

Apply flashing and metal components as required, such as step flashing at walls and metal valleys: 310

Apply asphalt capping to ridges and hip: 312

Referring to FIG. 24, which provides the additional steps for reroofing an existing asphalt shingled roof with metal panels, namely the steps are:

Apply metal panels over top of existing asphalt roof, creating a metal overlay: 314

Leave small gap at ridges or hips, at valleys and at wall junctions where small amounts of water may seep through, these gaps are normally less than 1/16" and normally not more than ½": 316

Apply no ridge and hip flashing, no valley flashing, no drip edge flashing, no flashing at wall junctions and gables: 318

Ridges and hips, valleys, drip edges, wall junctions and gables rely on existing flashings installed with traditional asphalt shingles roof to maintain water tightness: 320

Metal overlay provides semi-watertight seal. Existing asphalt completes watertight seal: 322

Metal overlay together with asphalt roof creates watertight seal: 324

Metal overlay prevents further degradation of asphalt components by shielding from sunlight, UV rays, excessive moisture, snow, hail, wind, ice, and fire: 326

Optionally bending the metal panels overlap the metal panels thereby maximizing the water shedding ability of the metal panels and minimizing the gaps: 327

Optionally, adding decorative components to improve aesthetic appeal and to visually conceal gaps thereby maximizing the water shedding ability of the metal panels and minimizing the gaps: 329.

The reader will note that any decorative components will enhance the look of the finished roof and may improve the water tightness in the area where they are applied. The main function of the decorative components is to visually conceal gaps that may be plainly visible from a ground view.

Figure 21:
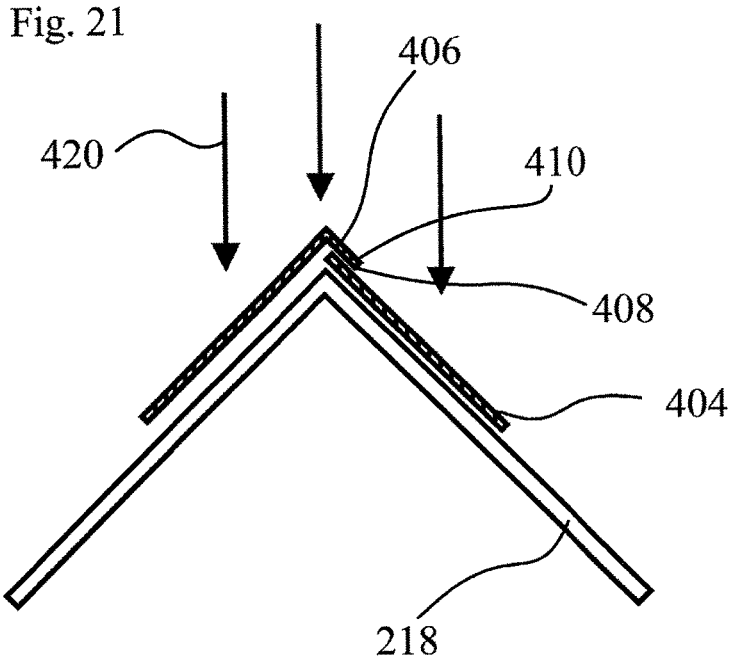
FIG. 21 is a schematic view of metal panel folded over onto an adjacent metal panel with precipitation coming downwardly.
Figure 22:
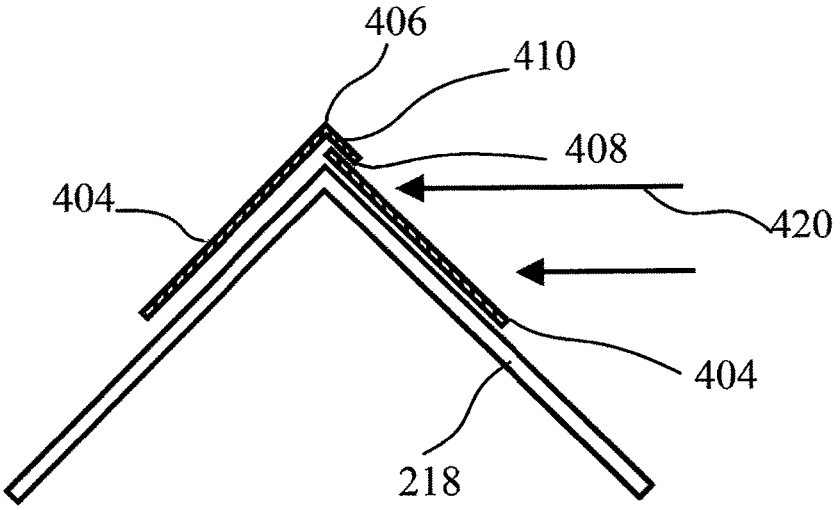
FIG. 22 is a schematic view of a metal panel folded over onto an adjacent metal panel with horizontally impinging precipitation.

Additionally other techniques may be used to conceal the gaps such as overlapping metal panels at a peak for example and or bending panels such that they can be positioned in an overlapping position or a gap concealing position. These techniques may improve water shedding ability as shown in FIG. 21 but may not improve water tightness as shown in FIG. 22. These techniques do not create the water-tightness as for example using traditional installation methods.

FIG. 21 depicts schematically a wood deck 218 and metal panels 404 one with a bend 406 to create an overlap, in this case over top of the other panel, creating overlap portion 410. The overlapping may in fact be over any portion of the roof such as another panel or a portion of a wall for example. There is a gap 408 that still exists between metal panels 404 however when precipitation 420 falls vertically as in FIG. 21 the panels create effective water shedding however when the precipitation is driven horizontally as in FIG. 22 some water may seep into the gap 408.

Adding decorative components to visually conceal gaps can maximize the water shedding ability of the metal panels and minimize the gaps. Similarly bending the metal panels to overlap to create an overlap also can maximize the water shedding ability of the metal panels and minimize the gaps.

With this system, all components and installation work together to produce a watertight installation regardless of the presence of gaps.

It should be apparent to persons skilled in the arts that various modifications and adaptation of this structure described above are possible without departure from the spirit of the invention the scope of which defined in the appended claim.

I claim:

1. A method for use with a roof of the type having a wooden deck, one or more features selected from valley, hip, roof to wall, ridge and gable, a flashing provided for each of said one or more features, the flashing overlying the wooden deck; and asphalt shingles overlying the deck and the flashing provided for each of said one or more features, the method comprising the steps:

fastening a plurality of one piece metal panels to the deck by nails that penetrate the asphalt shingles into the deck, with substantially all of the metal panels in direct contact with the asphalt shingles, inclusive of the shingles overlying the flashing, thereby creating a metal overlay configured such that substantially all of the asphalt shingles are covered with the metal panels and substantially all of the metal panels are separated from flashing by the shingles, the metal overlay being characterized by a plurality of seams between the panels that extend horizontally.

2. The method of claim 1, wherein the panels are of the hidden fastener type, each panel having, in use, an upper portion and a lower portion, the upper portion being secured to the deck and in direct contact with the asphalt shingles.

3. The method of claim 2, wherein the panels are interlocked with one another such that, at each seam, a lower portion of a panel overlies and is interlocked with the upper portion of an adjacent panel.

* * * * *